United States Patent [19]

Bolton et al.

[11] 4,434,710

[45] Mar. 6, 1984

[54] GRILLE MOUNTING MEANS AND METHOD

[75] Inventors: Theodore S. Bolton, Liverpool; Brad G. Leech, Fayetteville; Richard D. Lang, Chittenango, all of N.Y.

[73] Assignee: Carrier Corporation, Syracuse, N.Y.

[21] Appl. No.: 437,919

[22] Filed: Nov. 1, 1982

Related U.S. Application Data

[63] Continuation of Ser. No. 259,869, May 4, 1981, abandoned.

[51] Int. Cl.[3] ..... F24F 1/02

[52] U.S. Cl. ..... 98/94 AC; 98/99.6; 98/121 R; 292/259 R

[58] Field of Search ..... 52/473; 62/262, 298; 98/29, 88.5, 99.6, 99.8, 94, 114, 121 R; 292/259, DIG. 32; 312/100, 101, 111, 223, 257 SK

[56] References Cited

U.S. PATENT DOCUMENTS

| | | | |
|---|---|---|---|
| 1,687,538 | 10/1928 | Bradbury | 292/259 |
| 1,942,732 | 1/1934 | Shepard | 292/259 |
| 1,958,342 | 5/1934 | Johnson | 98/99.8 X |
| 2,628,056 | 2/1953 | Fuller | 220/314 X |
| 2,891,615 | 6/1959 | Farrell | 98/29 X |
| 3,813,117 | 5/1974 | Hackney, Jr. et al. | 292/DIG. 32 X |
| 3,864,887 | 2/1957 | Arehs | 52/473 X |
| 3,919,807 | 11/1975 | Meffur | 292/259 X |
| 4,304,175 | 12/1981 | Lang et al. | 98/114 X |

FOREIGN PATENT DOCUMENTS

| | | | |
|---|---|---|---|
| 6703992 | 9/1968 | Netherlands | 52/473 |
| 1316265 | 5/1973 | United Kingdom | 98/121 R |

*Primary Examiner*—Albert J. Makay
*Assistant Examiner*—Harold Joyce
*Attorney, Agent, or Firm*—Robert P. Hayter

[57] ABSTRACT

Apparatus and a method are disclosed for mounting a grille assembly to a sleeve designed for installation of an air conditioning unit. Rotatable mounting channels are secured to brackets of the grille assembly and may be manipulated from the interior of the sleeve to allow the grille assembly to be secured to the sleeve from the interior of the building. The sleeve includes a sleeve flange coacting with the grille flange and a channel support member having notches for receiving the rotatable mounting channels of the grille assembly for affixing the grille assembly to the sleeve.

10 Claims, 4 Drawing Figures

GRILLE MOUNTING MEANS AND METHOD

This application is a continuation of application Ser. No. 259,869 filed May 4, 1981 now abandoned.

BACKGROUND OF THE INVENTION

1. Field of the Invention

This invention relates in general to means for securing a grille to a wall sleeve adapted to be utilized with an air conditioning unit. More specifically, this invention concerns a grille assembly for allowing a grille to be attached to a sleeve from within the sleeve and with means for securing the grille to the sleeve being hidden from external view.

2. Prior Art

Air conditioning units which are commonly used for light commercial applications such as hotels, dormatories and office buildings often are of the type known as a packaged terminal air conditioner. These packaged terminal air conditioners extend through the wall of the enclosure and normally have a condensing section located in communication with ambient air for discharging heat energy. An evaporator section of the unit is provided in communication with the enclosure air for conditioning said air as it is drawn through the unit.

Room air conditioning units and other self-contained units are also used to condition the air for residences and small businesses. Room units may be either mounted in a window or extend through the wall such that a portion of the unit is located to communicate with ambient air. These units, both the packaged terminal air conditioner type and the room air type, are usually spaced along an exterior wall of the enclosure to be conditioned. The unit is so positioned such that heat energy to be dissipated from the enclosure to be cooled may be discharged to the ambient air. By communicating the outdoor condensing section of the air conditioning unit with ambient air heat energy absorbed by the refrigerant in communication with the indoor air may be discharged to the outdoor air. Hence, it is of necessity that each of these units have ambient air circulated in communication with a condenser to absorb heat energy being discharged from the air conditioning unit when it is operating to supply cooled air to an enclosure.

In many applications extending through a wall such as a casement or packaged terminal air conditioning type unit, the unit may be located in a building numerous floors in height. The installation of such a unit normally involves a casing or sleeve being inserted through an opening constructed in the exterior wall, said sleeve being adapted to have attached thereto a grille for covering the opening defined by the sleeve for allowing air flow between the ambient air and the condensing section of the unit. When these units are spaced from the ground it is particularly desirable that the grille be attached to the sleeve from inside the unit such that for repair purposes, as well as initial installation, the grille may be attached from inside the building. Additionally, by the assembly being from within the unit it is possible to avoid, during construction of the building, the necessity for additional elevated work outside the building for the purpose of installation of the air conditioning units. During construction of a building the wall sleeves are often positioned months before the units are installed. By providing grille assemblies installable at a later time theft, vandalism or other damage during construction may be avoided. Since the exterior surface of the unit is visible from the outside of the enclosure it is desirable to build a visually attractive unit. To accomplish this result, the invention as disclosed herein incorporates channel means for securing the grille to the sleeve without any fasteners being visible from the exterior of the building. Additionally, to aid in the attractive appearance of the unit, the grille is formed from aluminum which does not rust or discolor with exposure to the elements. The fastening means for securing the grille to the casing is within the unit, consequently the potential of rusting screws being visible from the exterior of the unit is eliminated.

SUMMARY OF THE INVENTION

An object of the invention is to provide a grille assembly and sleeve which may be used for mounting an air conditioning unit.

A further object of the present invention is to provide a means for securing a grille assembly to a sleeve such that the assembly of the two may be accomplished from within the sleeve.

Another object of the present invention is to provide a combination sleeve and grille wherein the means for securing the grille to the casing is not directly visible by an observer exterior to the enclosure in which the air conditioning unit may be mounted.

Another object of the present invention is to provide a safe, economical, easy to manufacture and easy to assemble combination grille assembly and sleeve for use with an air conditioning unit.

Other objects will be apparent from the description to follow and the appended claims.

The above objects are achieved according to a preferred embodiment of the present invention by the provision of a grille assembly adapted to cover an opening through an enclosure wall, said opening being defined by a sleeve. The grille assembly includes a series of spaced louvers secured in louver support means for maintaining the louvers in a predetermined position, a grille frame outlining the exterior surfaces of the grille assembly and including a grille flange and mounting channels secured to the louver support means for rotatable motion relative thereto. A sleeve which defines the opening through the wall includes a sleeve flange adapted to abut against the grille flange (either directly or through a spacer) when the grille assembly is mounted to the sleeve. In addition thereto a sleeve support member extends inwardly from the sleeve flange and has notches therein. The notches are so arranged that upon rotation of the mounting channels, the channels engage the notches to secure the grille assembly to the sleeve with the grille flange engaging the sleeve flange. The channel is then locked in position with the grille assembly securely affixed to the sleeve.

DESCRIPTION OF THE PREFERRED EMBODIMENT

The embodiment herein described will be in reference to a grille assembly and sleeve for use with a packaged terminal air conditioning unit. It is to be understood that the invention herein has like applicability to other types of self-contained air conditioning units extending through a wall such that the grille assembly is mounted on the exterior face of an enclosure. It is to be further understood that this invention has applicability to other types of air conditioning units and air handling units. This invention may also be applied to grille assemblies for the introduction and discharge of air from an enclosure.

Figure 1:
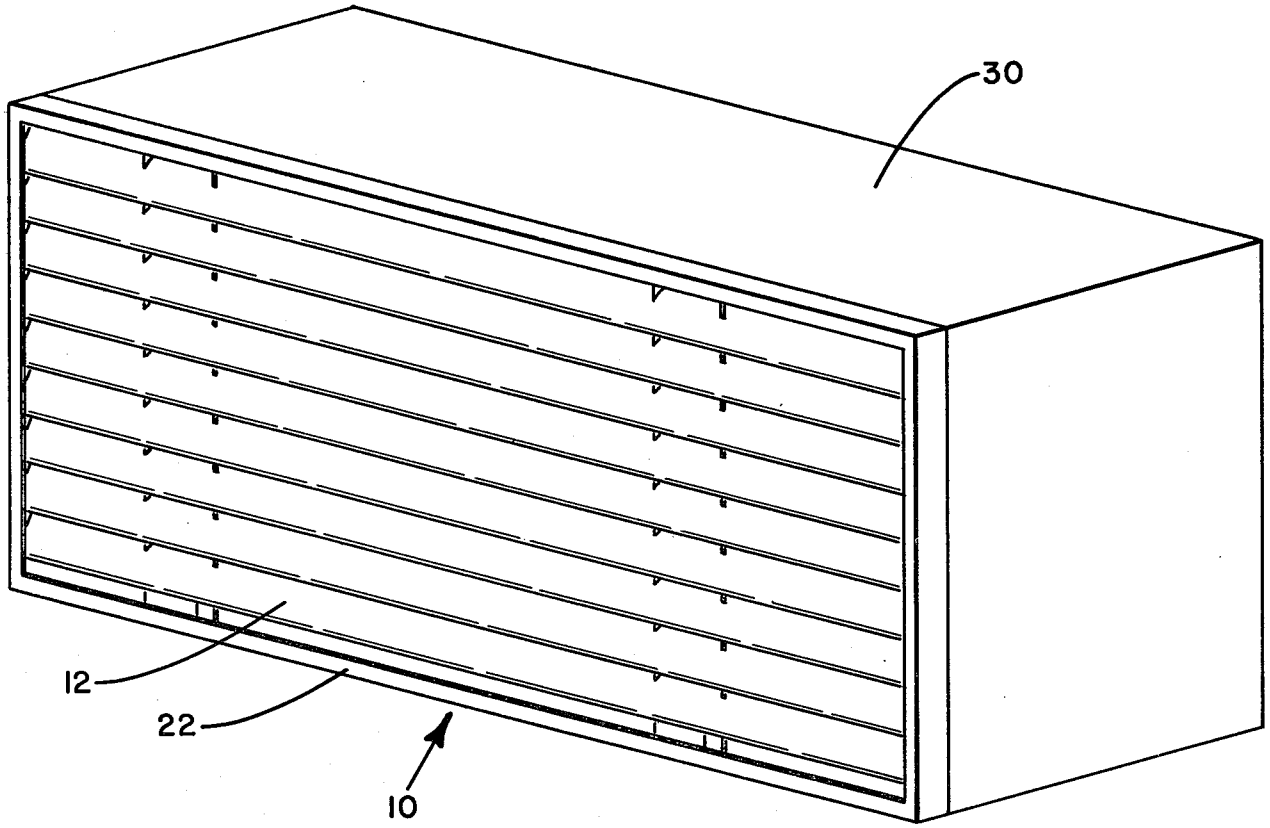
FIG. 1 is a perspective view of the sleeve having a grille assembly affixed thereto.

Referring first to FIG. 1 there can be seen a perspective view of a sleeve 30 having grille assembly 10 mounted to the face thereof. Grille frame 22, having louvers 12 extending across the front thereof, is shown covering the entire end of sleeve 30.

Figure 2:
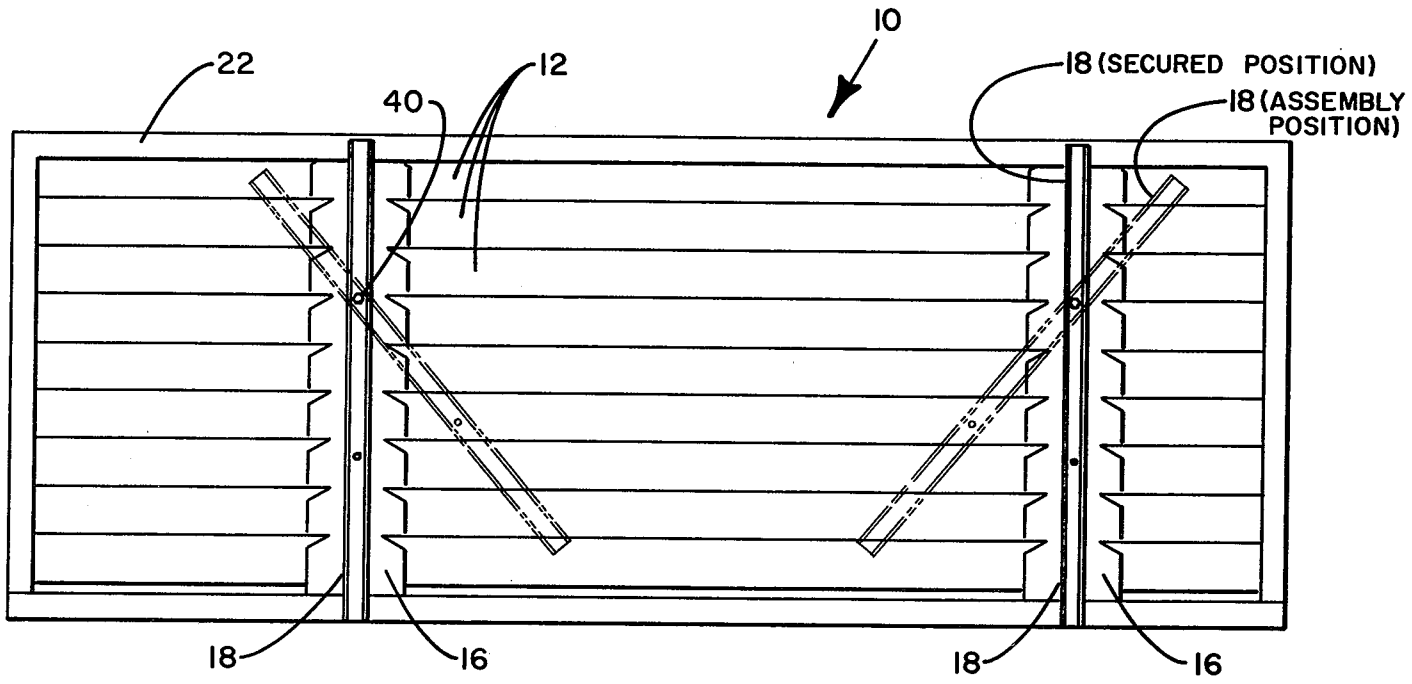
FIG. 2 is a side view of the back of the grille assembly showing mounting channels in the secured position and the assembly position.

In FIG. 2 louvers 12 are shown extending horizontally and are secured in louver support means or brackets 16. The brackets have individual slots into which the louvers are mounted and held. A grille frame 22 extends about the entire periphery of the grille assembly with louvers extending horizontally between the edges of the grille frame. Mounting channels 18 are secured to the brackets by pivot bolt 40. As shown in FIG. 2, the mounting channels 18 are in the secured position wherein they extend beyond that area where the louvers are located. The mounting channels 18 are also shown in phantom in FIG. 2 rotated to an assembly position wherein they do not extend outwardly beyond the area of the louvers.

Figure 4:
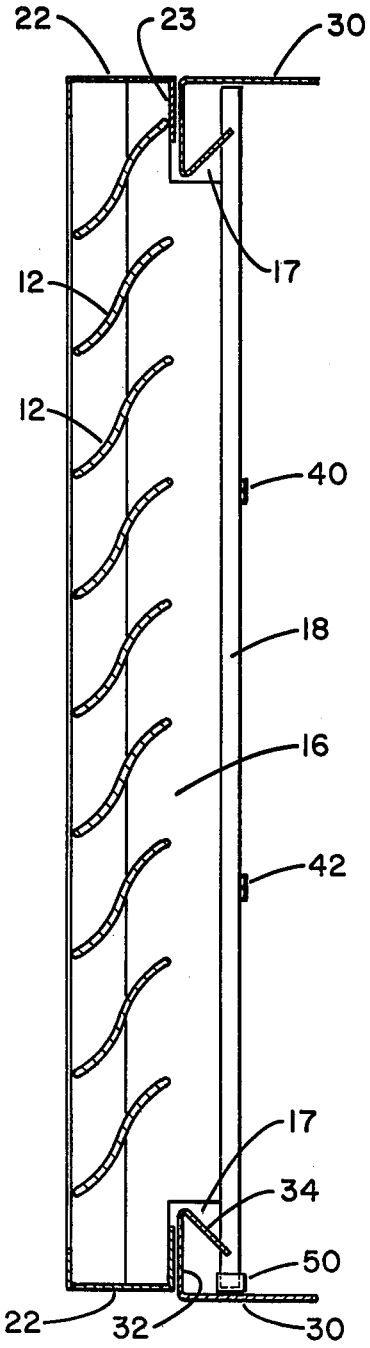
FIG. 4 is a side view of the grille assembly and wall sleeve.
Figure 3:
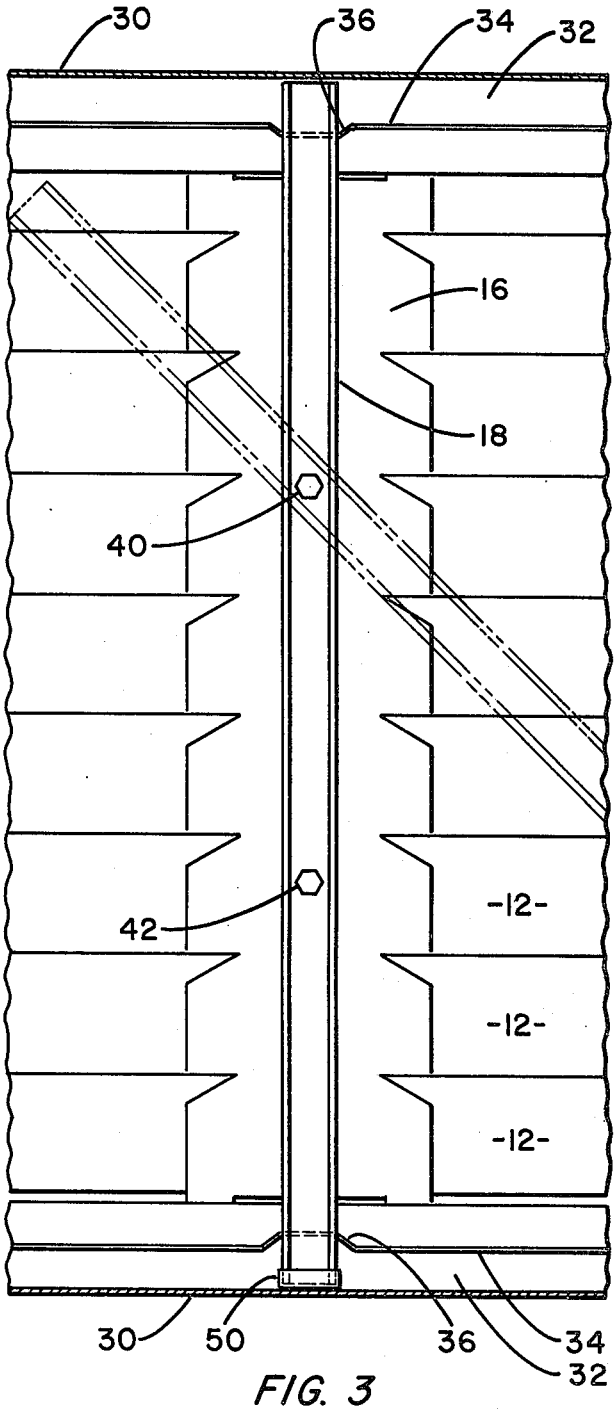
FIG. 3 is an enlarged portion of FIG. 2 showing the louver support means and the mounting channel.

FIG. 3 is an enlarged view of a portion of FIG. 2. FIG. 4 is an end view drawn to the same scale as FIG. 3. It can be seen therein that louvers 12 are angled in configuration and extend across the face of the unit such that air flow therethrough is substantially unimpeded while the internal components of the unit are hidden from view. Bracket 16 secures louvers 12 intermediate the ends thereof. Grille frame 22 includes grille flanges 23 extending inwardly. Additionally, brackets 16 have bracket slots 17 at both ends thereof. Grille flange 23 extends inwardly into the slot portion of the bracket.

The use of a grille frame is optional. The brackets are sufficient to maintain the louvers in position. When a grille frame is not used the edges of the louvers may serve as the grille frame or a grille frame portion. The brackets may also serve as a portion of the frame abutting against the sleeve surfaces.

Sleeve 30 has sleeve flange 32 extending inwardly therefrom and channel support member 34 extending from the end of sleeve flange 32. In FIG. 4, it can be seen that sleeve flange 32 and channel support member 34 are located in bracket slots 17. Channel support member 34 defines notches 36 as may be seen in FIG. 3. It is within notches 36 of channel support member 34 that mounting channel 18 is secured. As shown in the secured position, mounting channel 18 has each end thereof extending beyond channel support member 34 and located within notches 36. Pivot bolt 40 (may be rivet) and fastening bolt 42 are both engaged to secure the mounting channel to the bracket such that it is securely fixed in such position. When mounting channel 18 is fixed in this position, the grille assembly is secured to the sleeve with grille flange 23 contacting sleeve flange 32 and mounting channel 18 contacting channel support member 34 such that the combination of the sleeve flange and the channel support member are secured between the grille frame and the mounting channel to affix the grille assembly to the sleeve. Plastic caps 50 may be mounted on the end of mounting channel 18 such that the plastic cap abuts sleeve 30 to secure the grille assembly in the vertical direction.

Assembly

To assemble the grille assembly to the sleeve the first operation is normally to mount the sleeve in the wall. Once the sleeve is secured in the wall the mounting channels 18 are then placed in the position shown in phantom in FIG. 2. The fastening bolts 42 are removed and the mounting channels pivoted about pivot bolts 40. The installer may physically utilize the mounting channels as a handle, grabbing them and manipulating the assembly therefrom. With the mounting channels 18 in the assembly position as shown in phantom in FIG. 2, the ends of the mounting channels do not extend beyond the inwardly extending sleeve flanges 32 and the grille assembly may be slid through the opening defined by the sleeve.

Once the grille assembly is located exterior of the sleeve flange, the operator utilizing the mounting channels as handles places the grille assembly in position with grille flange 23 contacting sleeve flange 32. Spacers may be provided to maintain a distance between the grille flanges and sleeve flanges if desired. Once the grille assembly is in position, mounting channels 18 are rotated to the vertical position shown as the secured position in FIG. 2 wherein the ends of mounting channel 18 each engage a notch 36 in channel support member 34 of the sleeve. The grille assembly has now been affixed relative to the sleeve. Fastening bolts 42 are then installed and bolts 40 tightened to form an integral grille assembly and sleeve combination. As the fastening bolts are tightened the assembly actually bows a minor amount further acting to tightly secure the assembly to the sleeve.

The invention herein has been described in reference to a particular embodiment thereof. It is to be understood that variations and modifications can be effected within the spirit and scope of the invention.

What is claimed is:

1. Apparatus for mounting spaced louvers to cover an opening in a building while allowing air flow therethrough which comprises:

a wall sleeve defining the opening, said wall sleeve including inwardly extending sleeve flanges and member support means associated with at least one sleeve flange; and a grille assembly adapted to be mounted to the wall sleeve from the interior of the building to form a portion of the exterior of the building including louver support means for maintaining the spaced louvers in a predetermined position, said louver support means engaging and extending inwardly from the louvers;

a grille frame defining a grille opening across which the spaced louvers are maintained, said frame including inwardly extending grille flanges which abut against the sleeve flanges upon assembly; and a pair of mounting members rotatably secured to the louver support means and spaced from the louvers, said mounting members serving as a handle for manually manipulating the grille assembly from the interior of the building and further engaging the member support means to secure the grille assembly to the wall sleeve when rotated to the appropriate position.

2. The apparatus as set forth in claim 1 wherein the grille flanges engage the exterior side of the sleeve flanges and wherein the mounting channel engages the channel support means interior of the sleeve flanges whereby the grille assembly is secured to the wall sleeve by maintaining the sleeve flanges and channel support means between the grille flanges and the mounting channel.

3. The apparatus as set forth in claim 2 wherein the channel support means is a member extending from the sleeve flange, said member defining notches wherein the mounting channel may be maintained to secure the grille assembly to the wall sleeve.

4. The apparatus as set forth in claim 1 and further including mounting means for rotatably securing the mounting channel to the louver support means, said mounting means including a pivot bolt which secures the mounting channel to the louver support means while allowing rotation therebetween and a fastening bolt for securing the mounting channel in engagement with the channel support means.

5. The apparatus as set forth in claim 1 wherein the louver support means includes bracket slots at both ends thereof, said sleeve flanges fitting within the bracket slots upon assembly of the grille assembly to the wall sleeve.

6. A method of mounting a grille assembly including spaced louvers secured by a louver support means, a grille frame and rotatably affixed mounting channels to a wall sleeve defining an opening through a wall and including a sleeve flange such that the grille assembly may be mounted to the exterior of the wall sleeve from within the wall sleeve which comprises the steps of rotating the mounting channels to an assembly position to allow the grille assembly to be positioned relative to the wall sleeve and to allow the mounting channels to act as a handle for manual manipulation of the grille assembly;

positioning the grille assembly at the end of the wall sleeve with the grille frame abutting the sleeve flange; and displacing the mounting channels such that the mounting channels engage the wall sleeve securing the grille assembly to the wall sleeve.

7. The method as set forth in claim 6 and further including the step of securing the mounting channels after the step of displacing to prevent further displacement of the mounting channels.

8. The method as set forth in claim 6 wherein the sleeve flange includes a channel support member having notches for the receipt of the mounting channels and wherein the step of displacing the mounting channels includes locating the channels in the notches of the channel support member.

9. The method as set forth in claim 6 wherein the steps of rotating, positioning and displacing may all be accomplished from within the wall sleeve.

10. The method as set forth in claim 6 and further including the step of:

providing mounting channels suitable for serving as handles to allow an operator to manipulate the grille assembly by grasping the mounting channels.

* * * * *